US006559404B1

(12) United States Patent
Ookawa et al.

(10) Patent No.: US 6,559,404 B1
(45) Date of Patent: May 6, 2003

(54) VACUUM CIRCUIT INTERRUPTER

(75) Inventors: Yoshihiro Ookawa, Tokyo (JP); Shinichi Miki, Tokyo (JP); Masahiro Arioka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/864,879

(22) Filed: May 25, 2001

(30) Foreign Application Priority Data

May 26, 2000 (JP) ..... 2000-156697

(51) Int. Cl.[7] ..... H01H 33/02
(52) U.S. Cl. ..... 218/155; 361/604
(58) Field of Search ..... 218/43, 68, 78, 218/155, 44–50, 80–84; 361/600–608

(56) References Cited

FOREIGN PATENT DOCUMENTS

| | | |
|---|---|---|
| JP | 47-40159 | 12/1972 |
| JP | 11-146514 | 5/1999 |

OTHER PUBLICATIONS

English language Abstract. JP11146514. May 28, 1999.

*Primary Examiner*—Elvin Enad
*Assistant Examiner*—M. Fishman
(74) *Attorney, Agent, or Firm*—Sughrue Mion, PLLC

(57) ABSTRACT

A vacuum circuit interrupter for use in a switchgear connectable to a three-phase ac power system and having for each phase a vacuum valve including a pair of separable electrodes supported within a hermetic vessel by an electrode. Axes of the vacuum valves for three phases are arranged in parallel and at apexes of a triangle. Electrically insulating barriers are disposed for supporting and electrically insulating the vacuum valve from another vacuum valve in another phase and from the hermetic vessel.

8 Claims, 2 Drawing Sheets

VACUUM CIRCUIT INTERRUPTER

CROSS REFERENCE TO RELATED APPLICATION

This application is based on Application No. 2000-156697, filed in Japan on May 26, 2000, the contents of which are hereby incorporated by reference.

BACKGROUND OF THE INVENTION

This invention relates to a vacuum circuit interrupter and, more particularly, to a vacuum circuit interrupter for use in a switchgear for a three-phase ac circuit provided with a device for interrupting the power system upon the generation of a fault in the power system for example.

In a conventional switchgear for a three-phase ac circuit, as shown in FIG. 3, three vacuum valves 3, 4 and 5 constituting a vacuum circuit interrupter 2 are disposed within a hermetic vessel 1 filled with an electrically insulating gas, with their axes arranged in parallel and side-by-side in a plane. Disposed between the hermetic vessels 3, 4 and 5 are electrically insulating barriers 6 for maintaining a necessary insulating distance therebetween. Also, electrically insulating barriers 6 made of an insulating material are inserted between the vacuum valves 3 and 5 and the hermetic vessel 1 in order to make the switchgear small-sized.

However, in the vacuum circuit interrupter 2 having the vacuum valves 3 to 5 arranged as above described, since the vacuum valves 3 to 5 are arranged in parallel in a plane, even when efforts are exerted to minimize the vacuum circuit interrupter 2 by inserting the insulating barriers 6 between the vacuum valves 3 to 5 and the hermetic vessel 1 to increase the insulating distance, there was a limitation in decreasing the size, particularly the width dimension, of the vacuum circuit interrupters 2 and the switchgear containing the vacuum circuit interrupters 2.

Accordingly, the main object of the present invention is to provide a vacuum circuit interrupter free from the above problems of the conventional vacuum circuit interrupter.

Another object of the present invention is to provide a vacuum circuit interrupter having a small width dimension and suitable for use in a compact switchgear.

SUMMARY OF THE INVENTION

With the above objects in view, the present invention resides in a vacuum circuit interrupter for use in a switchgear connectable to a three-phase ac power system and having for each phase a vacuum valve including a pair of separable electrodes supported within a hermetic vessel by an electrode, characterized in that axes of the vacuum valves for three phases are arranged in parallel and at apexes of a triangle.

The vacuum circuit interrupter may further comprise an electrically insulating barrier for insulating said vacuum valve from another vacuum valve in another phase and from said hermetic vessel.

The vacuum valves may be supported by said insulating barrier.

The insulating barriers may be partially overlapped each other between the vacuum valve and the hermetic vessel.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
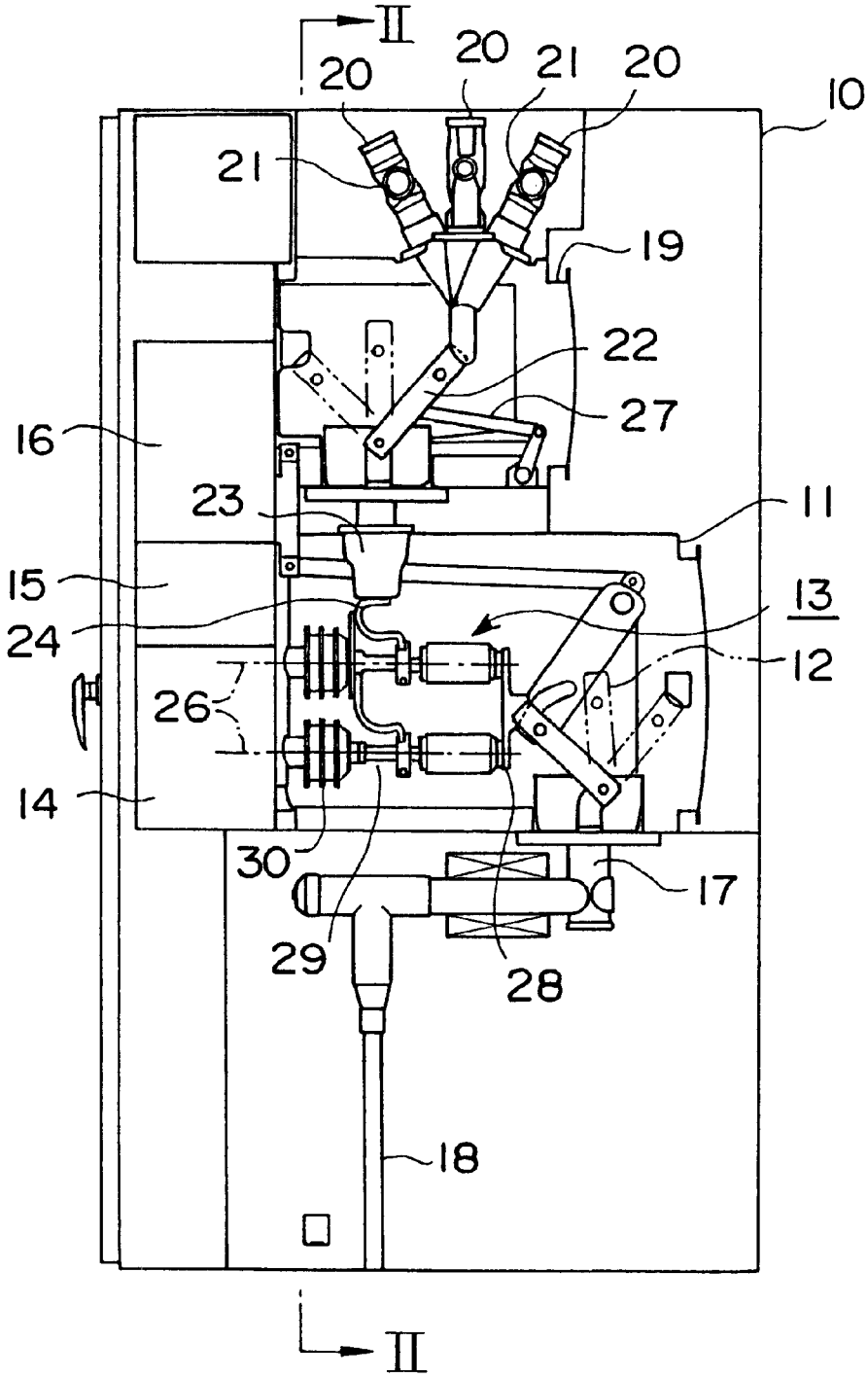
FIG. 1 is a schematic side view showing the structure of a gas insulated switchgear in which the vacuum circuit interrupter of the first embodiment of the present invention is used.
Figure 2:
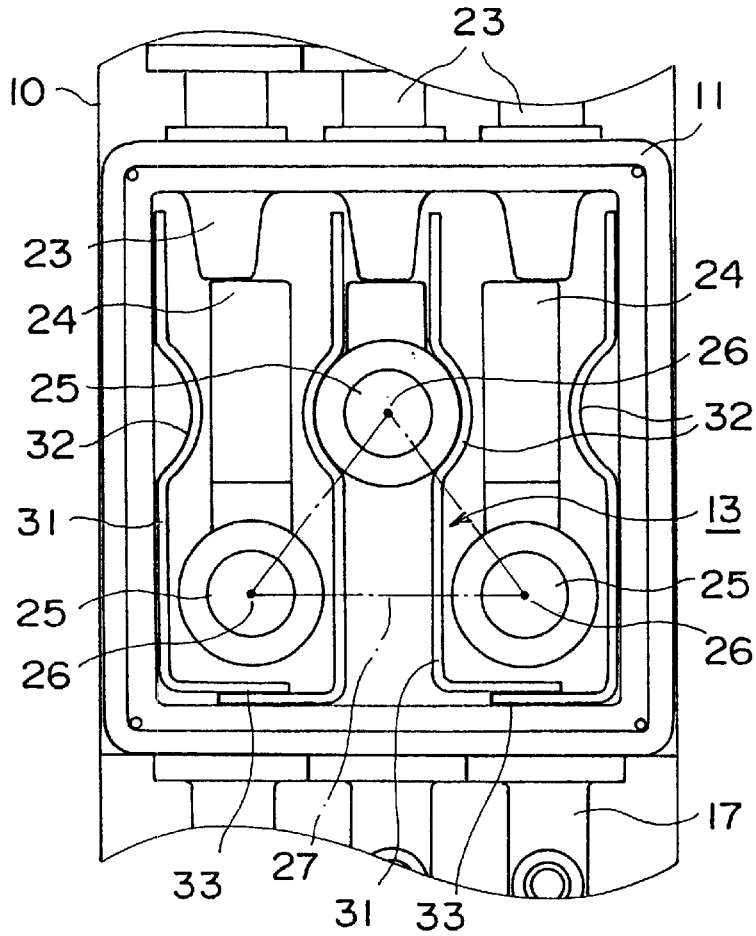
FIG. 2 is a sectional view taken along line II—II of FIG. 1.

The present invention will now be described in conjunction with a vacuum circuit interrupter for use in a gas-insulated switchgear that can be connected to a three-phase ac power system. The vacuum circuit interrupter comprises, for each phase, a vacuum valve including a pair of separable electrodes supported within a hermetic vessel by an electrode In FIGS. 1 and 2, of which FIG. 1 is a schematic side view showing the structure of a gas insulated switchgear in which the vacuum circuit interrupter of the first embodiment of the present invention is used and FIG. 2 is a sectional view taken along line II—II of FIG. 1, disposed within a distribution box 10 of the gas-insulated switchgear for a three-phase ac circuit are a disconnector 12 and a vacuum circuit interrupter 13. The vacuum circuit interrupter 13 is operated between the open and the closed positions by an operating mechanism 14 disposed at the outside of the hermetic vessel 11 and the front of the distribution box 10. The hermetic vessel 11 also contains therein a disconnector 12, which is arranged to be operated by a disconnector operating mechanism 15 disposed at the front face of the distribution box 10. The disconnector 12 is connected to the outwardly extending cable 18 through a bushing 17.

Further disposed within the distribution box 10 is a second hermetic vessel 19 disposed above the first hermetic vessel 11, within which a disconnector 22 connected to insulated bus conductors 21 by means of bushings 20 extending upwardly from a top wall of the second hermetic vessel 19. The disconnector 22 is operated by a disconnector operating mechanism 16. From this disconnector 22, bushings 23 extend outwardly through the second hermetic vessel 19 and penetrating into the first hermetic vessel 11, where tips of the bushings 23 are connected to the respective vacuum circuit interrupters 13 by means of flexible conductors 24.

As shown in FIGS. 1 and 2, the vacuum circuit interrupter 13 comprises three vacuum valves 25 corresponding to the respective phases of the three-phase circuit. The vacuum valves 25 are arranged so that their axes 26 extend in parallel to each other and that a triangle 27 is obtained when the points of intersection between the axes 26 and a plane perpendicular to the axes 26 are connected by straight lines. In other words, in the bottom portion of the hermetic vessel 11, two vacuum valves 25 are disposed in parallel and spaced apart from each other in a direction perpendicular to the plane of the figure and a third vacuum valve 25 is disposed at the position above and separated equidistantly from the horizontally spaced first and second vacuum switches 25. That is, the axes 26 of the vacuum valves 25 for three phases are parallel arranged to define apexes of the triangle 27. This triangle 27 may be arbitrary, but an isosceles triangle is preferable and an equilateral triangle is more preferable.

Each of the vacuum valves 25 constituting the vacuum circuit interrupter 13, of which right side in FIG. 1 is a stationary contact (not shown) side and is supported by a stationary support portion disposed to a suitable portion of the hermetic vessel 11 through a fixing member 28 and is electrically connected to the disconnector 12, and the left side is a movable contact side connected to the operating mechanism 14 outside of the hermetic vessel 14 through a movable rod 29 and an electric insulator 30 so that all three vacuum valves 25 can achieve the same and simultaneous opening and closing operation by an unillustrated linkage. In this manner, the pair of separable electrodes are separated.

Figure 3:
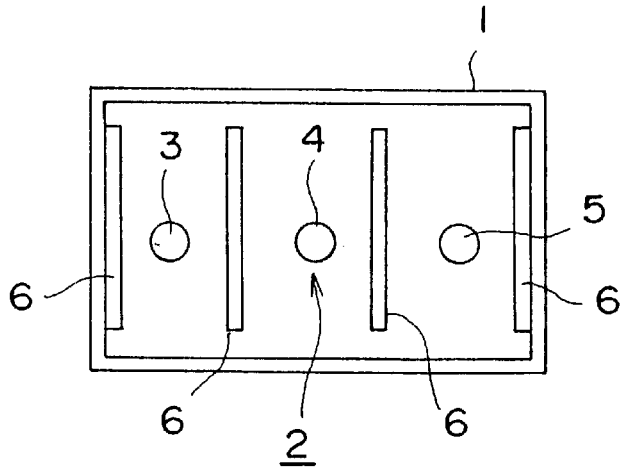
FIG. 3 is a view for illustrating an arrangement of a conventional vacuum valves.

As is apparent from FIG. 2, in the vacuum circuit interrupter 13 of the present invention, the width dimension of the vacuum circuit interrupter 13 is determined by a distance between the vacuum valves 25 at the opposite sides or the distance between two vacuum valves 25. Contrary to this, when three vacuum valves 3, 4 and 5 of the conventional vacuum circuit interrupter 2 are arranged side-by-side as shown in FIG. 3, the width dimension of the vacuum circuit interrupter 2 is determined by the distance between the outer-most vacuum valves 3 and 5 of three vacuum valves 3, 4 and 5 which is twice of the distance between the neighboring vacuum valves such as the vacuum valves 3 and 4 or the vacuum valves 4 and 5. Thus, according to the present invention, the width dimension of the vacuum circuit interrupter 13 can be decreased. The height dimension of the vacuum circuit interrupter 13 of the present invention is within the height dimension of the disconnector 12 even when three vacuum valves 25 are arranged in an equilateral triangle, so that the height does not exceed that of the conventional vacuum circuit interrupter such as that shown in FIG. 3.

The vacuum circuit interrupter 13 also comprises, as shown in FIG. 2, insulating barriers 31 made of an electrically insulating material and disposed between three vacuum valves 25 and between the outer-most vacuum valves 25 and the hermetic vessel 11. Each of the four insulating barriers 31 is made of a plate-like member of the substantially identical configuration of a substantially L-shape with an arcuated groove 32 formed in a longer leg of the "L". The shorter legs of the "L" of the two vacuum valves 25 are partially placed one on another or partially overlapped to form over-lapping portions 33 thereby to define a generally U-shaped assembly. It is seen that the outer-most vacuum valves 25 at the opposite sides are surrounded from below within the hermetic vessel 11 by the U-shaped assembly of the insulating barriers 31 and are supported from the mounting and supporting portion disposed on the insulating barrier 31 through the fixing member 28. On the other hand, the arcuated grooves 32 formed in the longer legs of the insulating barriers 31 surround the central vacuum valve 25 located at the top apex of the triangle 27 and support the this vacuum valve 25 at a substantially central position of the hermetic vessel 11 by the mounting and supporting portion of the insulating barriers 31.

Thus, according to the vacuum circuit interrupter 13 of the present invention, the axes 26 of the vacuum valves 25 of the respective phases are arranged in parallel to each other and at the apexes of a triangle, so that the width dimension of the vacuum circuit interrupter can be made small, whereby the switchgear containing the vacuum circuit interrupter can be made compact. Also, the insulating barriers 31 for insulating the vacuum valves 25 from another vacuum valve 25 in another phase and from the hermetic vessel 11 are provided, so that the insulating distance therebetween can be increased to permit the width dimension of the vacuum circuit interrupter further decreased, whereby the gas-insulated switchgear can be made smaller.

As has been described, the present invention resides in a vacuum circuit interrupter for use in a switchgear connectable to a three-phase ac power system and having for each phase a vacuum valve including a pair of separable electrodes supported within a hermetic vessel by an electrode, characterized in that axes of the vacuum valves for three phases are arranged in parallel and at apexes of a triangle. Therefore, the vacuum circuit interrupter and the switchgear can be made small and particularly the width dimension can be significantly reduced.

Also, the vacuum circuit interrupter may further comprise an electrically insulating barrier for insulating the vacuum valve from another vacuum valve in another phase and from the hermetic vessel, so that sufficiently large insulating distance can be obtained between the charged portions, allowing the vacuum circuit interrupter to be further minimized.

Also, the vacuum valves may be supported by the insulating barrier, so that the structure can be made simple.

Also, the insulating barriers may be partially overlapped each other between the vacuum valve and the hermetic vessel, so that a sufficient insulating distance to ground can be obtained, thus further allowing the vacuum circuit interrupter and the switchgear to be small-sized.

What is claimed is:

1. A vacuum circuit interrupter for use in a switchgear connectable to a three-phase ac power system and having for each phase a vacuum valve, a central phase vacuum valve being disposed at an apex of a top of an isosceles triangle and two outer phase vacuum valves for phases at opposite sides being disposed at apexes of a bottom of the triangle, the two outer phase vacuum valves for the phases at the opposite sides being respectively disposed within U-shaped insulating barriers, the U-shaped insulating barriers being disposed such that bight portions at a bottom of the U-shape are directed toward the bottom of the isosceles triangle and such that open ends thereof sandwich the central phase vacuum valve for electrical isolation or partition by leg portions of the U-shaped insulating barriers, characterized in that axes of said vacuum valves for three phases are arranged in parallel at said apexes of said triangle.

2. The vacuum circuit interrupter as claimed in claim 1, wherein the U-shaped barriers are divided into two pieces and overlapped at the bottom portion of the U-shape.

3. A vacuum circuit interrupter for use in a switchgear connectable to a three-phase ac power system and having three parallel vacuum valves disposed at apexes of an isosceles triangle, a central phase vacuum valve being disposed at an apex of a top of an isosceles triangle and two outer phase vacuum valves for phases at opposite sides being disposed at apexes of a bottom of the triangle, the central phase vacuum valve being disposed within an insulating barrier that electrically isolates and partitions the central phase vacuum valve from the vacuum valves for the phases at the opposite sides, the insulating barrier being deformed outwardly, each vacuum valve including a pair of separable electrodes supported within a hermetic vessel by an electrode.

4. The vacuum circuit interrupter as claimed in claim 3, wherein said outward deformation of said insulating barrier is a bent portion that extends along a circumferential surface of the central phase vacuum valve.

5. The vacuum circuit interrupter as claimed in claim 1, wherein said isosceles triangle is an equilateral triangle.

6. The vacuum circuit interrupter as claimed in claim 3, wherein said isosceles triangle is an equilateral triangle.

7. The vacuum circuit interrupter as claimed in claim 1, wherein said leg portions of the U-shaped insulating barriers are not physically in contact with the central phase vacuum valve.

8. The vacuum circuit interrupter as claimed in claim 3, wherein said insulating barrier is not physically in contact with the central phase vacuum valve.

* * * * *